US009510647B1

(12) United States Patent
Singh et al.

(10) Patent No.: US 9,510,647 B1
(45) Date of Patent: Dec. 6, 2016

(54) HIGH HEEL SHOE

(71) Applicant: Thesis Couture, Inc., Los Angeles, CA (US)

(72) Inventors: Navjeet K. Singh, Los Angeles, CA (US); Matt Thomas, Yorba Linda, CA (US); Amanda Parkes, Brooklyn, NY (US)

(73) Assignee: Thesis Couture, Inc., Los Angeles, CA (US)

( * ) Notice: Subject to any disclaimer, the term of this patent is extended or adjusted under 35 U.S.C. 154(b) by 0 days.

(21) Appl. No.: 15/236,478

(22) Filed: Aug. 15, 2016

Related U.S. Application Data

(60) Provisional application No. 62/205,459, filed on Aug. 14, 2015, provisional application No. 62/205,575, filed on Aug. 14, 2015, provisional application No. 62/205,578, filed on Aug. 14, 2015, provisional application No. 62/205,581, filed on Aug. 14, 2015, provisional application No. 62/205,584, filed on Aug. 14, 2015, provisional application No. 62/205,587, filed on Aug. 14, 2015.

(51) Int. Cl.

| | |
|---|---|
| ***A43B 13/37*** | (2006.01) |
| ***A43B 13/40*** | (2006.01) |
| ***A43B 13/41*** | (2006.01) |
| ***A43B 13/12*** | (2006.01) |
| ***A43B 13/30*** | (2006.01) |
| ***A43B 13/14*** | (2006.01) |
| ***A43C 11/14*** | (2006.01) |
| ***A43B 7/14*** | (2006.01) |
| ***A43B 7/30*** | (2006.01) |

(52) U.S. Cl.
CPC ..... *A43B 13/40* (2013.01); *A43B 7/148* (2013.01); *A43B 7/1425* (2013.01); *A43B 7/1445* (2013.01); *A43B 7/30* (2013.01); *A43B 13/125* (2013.01); *A43B 13/141* (2013.01); *A43B 13/30* (2013.01); *A43B 13/37* (2013.01); *A43B 13/41* (2013.01); *A43C 11/14* (2013.01)

(58) Field of Classification Search
CPC ..... A43B 7/30; A43B 7/148; A43B 13/125; A43B 13/37; A43B 13/188
USPC ..... 36/28, 24.5, 25 R, 107
See application file for complete search history.

(56) References Cited

U.S. PATENT DOCUMENTS 2,817,162 A * 12/1957 Castagnola ..... A43B 3/128 36/107
4,835,884 A * 6/1989 Bianchini ..... A43B 13/28 36/108

(Continued)

*Primary Examiner* — Marie Bays
(74) *Attorney, Agent, or Firm* — Steven C. Sereboff; Guy L. Cumberbatch; SoCal IP Law Group LLP

(57) ABSTRACT

There are disclosed high heel shoes where separate components combine to create load balancing internal footwear technology. A two-piece system includes interlocking toe bed and shank constructed of complex three dimensional curved surfaces which create an intricately sculpted volume to provide structural support down the length of the entire foot. The toe bed provides a wide base and keeps the big toe pointed straight (at an approximately 10° angle). A heel maximizes the surface area of the bottom of the heel at the point of strike with the ground while retaining a minimal and aesthetically appealing silhouette from the side view. The toe bed and shank feature a composition of layered materials which when combined work to provide both stability and shock absorption to the ball of the foot during the foot strike of walking. An internal support structure provides a padded barrier and intermediary between the rigidity of the shank and the softness of the shoe upper.

29 Claims, 7 Drawing Sheets

(56) References Cited

U.S. PATENT DOCUMENTS 5,367,791 A * 11/1994 Gross ..... A43B 13/26 36/25 R
5,619,809 A * 4/1997 Sessa ..... A43B 7/06 36/28
5,699,627 A * 12/1997 Castro ..... A43B 1/0045 36/28
8,302,233 B2 * 11/2012 Spanks ..... A43B 1/0072 12/142 F
8,826,567 B1 * 9/2014 Khaitan ..... A43B 21/00 36/28
2004/0221485 A1 * 11/2004 Pfander ..... A43B 1/0009 36/30 R
2007/0234590 A1 * 10/2007 Morales ..... A43B 7/1445 36/24.5
2007/0277401 A1 * 12/2007 Young-Chul ..... A43B 13/12 36/30 R
2014/0298680 A1 * 10/2014 Oloff ..... A43B 7/142 36/28

* cited by examiner

HIGH HEEL SHOE

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims priority from the following provisional patent applications, all of which are incorporated by reference: Application Nos. 62/205,459; 62/205,575; 62/205,578; 62/205,581; 62/205,584; and 62/205,587, all filed Aug. 14, 2015.

BACKGROUND

Field

This disclosure relates to high heel shoes, their methods of manufacture and structural components.

Description of the Related Art

High heel shoes are very popular for their aesthetic appeal. However, high heel shoes are typically not very comfortable and can cause pain in a wearer's foot when worn for prolonged periods of time. The use of high heel shoes and the elevation of the wearer's heel shifts the balance of the coronal plane of a body from back to front. Due to the shift of the coronal plane from back to front, the center of gravity of the body shifts towards the ball of the foot. This change of balance demands compensation in posture by other parts of the body causing the knees to bend slightly forward and pushing the hips and spinal cord out of alignment. This results in an increased amount of pressure on the ball of the foot rather than the heel bone. The change of the center of coronal balance pushes the weight of the body uncomfortably onto the metatarsals, sesamoids or floating bones of the foot instead of a natural distribution of force onto the heel bone.

Various methods for enhancing the comfort level of high heeled shoes have been attempted, such as inserts. However, inserts do not fit all shoe types and attempt to compensate for a poorly shaped shoe rather than correct the shoe itself.

Shoes typically are referenced with front, rear, top and bottom, which are all taken from the frame of reference of the wearer. Typical high heel shoes have three primary components, uppers, heel and sole. The uppers are at the top of the shoe and help hold the shoe onto the foot. The sole is between the foot and the ground. The heel provides lift and supports the heel of the foot.

The sole of a high heel shoe typically has an outsole, an insole which may include cushioning and a shank which is between the outsole and insole and which bridges the outsole to the heel. The outsole is the exposed part of the sole that is contact with the ground. The outsole provides grip with the ground and durability. The sole often includes an insole which is disposed above the outsole and provides a platform upon which the foot can operate. Where the ball of the foot sits on the sole is called the toe box. The shank supports the foot and the weight of the wearer. The shank is what provides the structural support, and strength between the heel and the ground, allowing the shoe to create the 'lift' of a high heel. The shank is akin to a support beam in architecture. It supports the foot and weight of the wearer at the angled position of the shoe.

The heel raises the rear of the shoe in relation to the front. The heel includes a seat where the heel of the wearer's foot sits in the shoe. The distance the wearer's heel is raised is called the heel height, and heel height is defined as the distance from the top of the toe box (where the ball of the foot rests) to the top of the seat. Heel height typically is between 20 mm to 140 mm, though higher heel heights can be accomplished with an accompanying platform under the toe bed section of the shoe. A top piece of the heel is where the heel comes in contact with the ground. The heel breast describes front face of the heel. A thin high heel is called a stiletto. The pitch is the angle between the toe bed (where the forefoot rests) and the heel seat (where the heel rests). In traditional heels, the incline, between the toe bed and the heel seat is a flat, angled plane, due to the flatness of the steel shank inside the sole. The lift is the total increase in a wearer's height while wearing the shoe. The bottom of the heel which comes in contact with the ground is referred to as the heel tip or top piece.

Shoes are open, closed or partially open, based upon whether the top of the foot is covered by the upper. If open or partially open, the upper includes straps, such as at the front (toe), mid, ankle or rear (heel).

Throughout this description, elements appearing in figures are assigned three- or four-digit reference designators, where the most significant digit of a three-digit number and the most significant two digits of a four-digit number is/are the figure number and the two least significant digits are specific to the element. An element that is not described in conjunction with a figure may be presumed to have the same characteristics and function as a previously-described element having a reference designator with the same least significant digits.

DETAILED DESCRIPTION

The functional components of the shoes described herein have a variety of specifications. These specifications include dimensions, shapes, thicknesses, strength, rigidity and flexibility, including variations of these throughout the component. The specifications of many of the components are related such that changes to one component suggest or require a change to other components. These specifications are selected based upon the intended wearer or range of wearers, such as ranges of weight and shoe size. Furthermore, intended use of the shoe, including useful life, may guide performance and tolerance requirements, which then impact specifications of the components. In the following description, a number of relative terms are used with respect to various shoe components. In practice, these relative terms serve as guides to how to achieve specific dimensions for a desired shoe.

Figure 1:
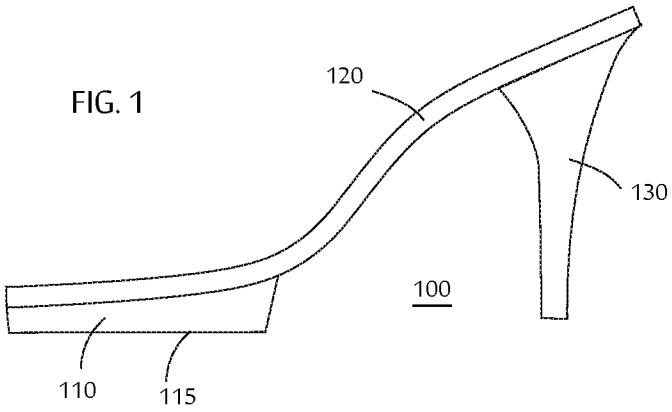
FIG. 1 is a side view of the main structural components of a first high heel shoe.

Referring now to FIG. 1, the main structural components of a high heel shoe 100 include a toe bed 110, a shank 120 and a heel 130. The shank 120, the toe bed 110 and the heel 130 are strong and rigid enough to maintain structural integrity and support the wearer during the intended use of the shoe 100. Through a composite, interlocking structure of these three structural components of the high heel shoe 100, forces imparted by the wearer are more evenly absorbed and distributed to provide a more comfortable experience.

The components 110, 120, 130 have geometric details to create an interlocking mechanism for assembly. The toe bed 110 attaches to the front of the shank 120 and the heel 130 attaches to the rear. The components 110, 120, 130 include joints (not shown) which 'click and lock' into place, such as with a one quarter turn. The interlocking mechanism creates structural continuity between the toe bed 110, shank 120 heel and 130, working to distribute loading between the components and avoiding the weak joints where standard shoes traditionally break, such where the heel joins the body of the shoe.

The toe bed 110 includes a composition of layered materials which when combined work to provide both stability and shock absorption to the ball of the foot during the foot strike of walking.

Unlike a conventional shank which is merely flat, stamped spring steel, the shank 120 extends from the wearer's toe area to heel area, and across the foot from left to right, is not flat but has varying thicknesses and varying outer dimensions. Unlike a conventional shank, which is a flat piece of spring steel and begins at the heel and ends where the shoe connects to the ground, the shank 120 has a precision sculpted geometry of varying thickness and varying dimensions. Think of it like a ski slope—on the traditional shoe, the wearer's weight comes down the flat incline of the steel shank and crashes down onto the floor hard. With the custom curved geometry of the shanks disclosed herein which match the underside geometry of the human foot, the slope is softer, and the 'skier' or 'load' does not crash hard into the ground but rather does down in a more controlled way. These improved shanks provide arch support via the asymmetry in the part's left and right side (in one shank, not referred to the left and right side shoes). Each shank has increased height toward the inside of the foot, to again match the geometry of the understand the foot. Since the wearer's arches create a higher 'ceiling' on the inside of the foot, these improved shanks are designed with a higher curve on the inside. Thus, the contact between the foot and the sole unit is maximized. This provides arch support which shifts weight off of the toe bed and back towards the heel, and improving load distribution. Furthermore, there is an increase the overall amount of surface area connecting the foot and sole, providing for superior load distribution. Traditional heels put a majority of the load on the toe bed area, but the improved shank changes this.

The shank 120 may have an outer profile which matches that of the toe bed 110, including a taper down as the combination extends from heel 130 to the ground below the toe bed 110 for the aesthetic effect of slimming the outline of the shoe 100. This aesthetic aspect may be provided in whole or in part by a welt (not shown).

The form of the toe bed 110 provides a slightly wider base than is provided by corresponding structures in conventional high heel shoes and keeps the big toe pointed straight (at an approximately 10 degree angle). This works to mitigate rotation in the ball of the wearer's foot and allows for natural positioning. The toe bed 110 may have a bottom surface 125 having a coating of a base layer of urethane tread (Shore 90) to provide traction with the ground to reduce slipping. The toe bed geometry is minimizes the displacement of the big toe. Traditional high heel shoes tend to push the big toe aggressively toward the other toes, which causes discomfort, foot damage and difficulty walking for some users.

Figure 2:
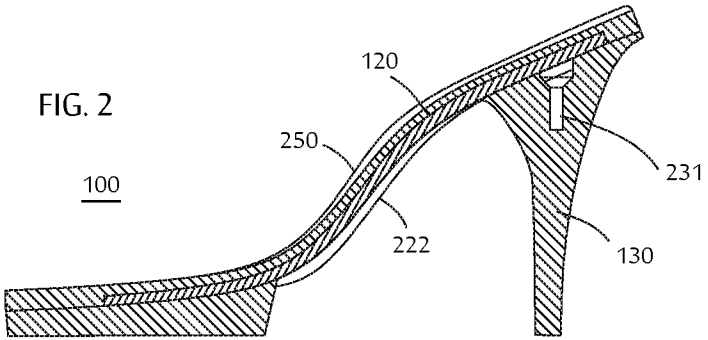
FIG. 2 is a cut-away view of the first shoe.

Referring now to FIG. 2, there is shown a cutaway side view of the shoe 100. An insole cushion 250 is disposed at the top surface of the shank 120. The insole cushion 250 forms an internal support structure of the shoe 100 functioning as a flexible, padded barrier and intermediary between the rigidity of the shank 120 and the softness of the uppers (not shown). The insole cushion 250 represents an intricate approach to nuanced geometries, and may be made of foam materials which have a broad range of compression states which can gently conform and support a greater variation of foot shapes. The insole cushion 250 may be made of a combination of viscoelastic polyurethane foam, commonly referred to as memory foam, and sorbothane, a viscoelastic polymer, in Shore durometers ranging from 30 to 50. The viscosity of memory foam allows the material to resist shear stress and strain when under pressure, while the elasticity provides a spring back property to provide support, holding the foot in compression. Together these properties provide comfort through gentle support optimized for a wider variety of foot shapes.

At the toe bed 110, the insole cushion 250 rises from the underside of the foot to the back of the foot to spherically support the rounded structure of the ball of the foot, reducing movement of the foot inside the shoe 100 during walking. It also runs under the pads of the foot and continues around the outer sides of the toe bed 110.

At the wearer's arch, the insole cushion 250 provides a gentle rise under the midsection of the foot. The goal is to not provide specialized rigid arch support like that of an orthotic shoe insert (which would be uncomfortable if not customized), but to provide a gentle soft compression support across the midsection of the shoe, holding the foot in place during walking.

The insole cushion 250 may be created through a combination of sheet foam (for flat 2D areas) and cast foam (for 3D structures) of both Sorbothane® and memory foam. Sheet foam, in the form of sheet stock, may be cut to size using a CNC knife. 3D components of the insole cushion 250 may be fabricated through reaction injection molding (RIM). The 3D components are modeled and the 3D model is inverted to create a 3D model of the mold. To mold memory foam, the two chemicals used to make the foam (isocyanate and polyol) are heated, mixed together and shot into the mold. Once in the mold the reaction of the hot mixture causes it to expand until it reaches the wall of the mold. When the hot mixture touches the relatively cold wall of the mold a foam skin forms. Depending on the geometries, the 2D and 3D components of the insole cushion 250 may be laminated together and applied to the shank 220 using a foam fast spray adhesive (such as Claire Mist, Camie 373 or 3M 77) where necessary.

A downwardly-projecting heel pin 231 rigidly fastened to the shank 120 extends down into a similarly-sized cavity formed in the heel 130. The heel pin 231 fits closely into the cavity and is secured therein, such as with adhesive, a friction-fit, and/or threads. The heel pin 231 may be metal or other strong, rigid material.

A rib 222 commences generally at the rear edge of the toe bed 110 and extends rearward to the heel 130. The rib 222 is an elongated central section of the shank 120 which projects below its bottom surface but not necessarily to the sides. The rib 222 provides longitudinal rigidity to the shoe 100 and essentially replaces the strength function of metal shanks that have previously been used in the production of high heel shoes.

Assembly of the shoe 100 may start with forming the shank 120 through a two part overmolding process. The toe bed 110 and the shank 120 may be made from a layered blend of polyether copolymer based thermoplastic polyurethane (TPU), sorbothane (Shore 50), and silicone gel (Shore 20), forming a multi-material composite that works to absorb some of the shock moving from the feet to hips, thus reducing the impact from heel to toe strike during walking. Other internal geometries of the layers within the shank 120 and the toe bed 110 may be included, such as honeycomb structures which enhance shock absorption while increasing support and stability.

For aesthetic benefit, the toe bed 110 and shank 120 may be enclosed and hidden in uppers (not shown). The uppers may include fabric, leather or bioleather, enclosures plus adornments (e.g., buckles, laces and decorative metal and fabric elements). The uppers may entirely encase the height of the toe bed 110, shank 120 and heel 130, creating a continuous surface from top of the foot to the ground. The uppers may be made in conventional processes from leather or other common fabric materials and function to encase the insole cushion 250 by wrapping and securing the foam elements in place through sewing and adhesive techniques.

Figure 3:
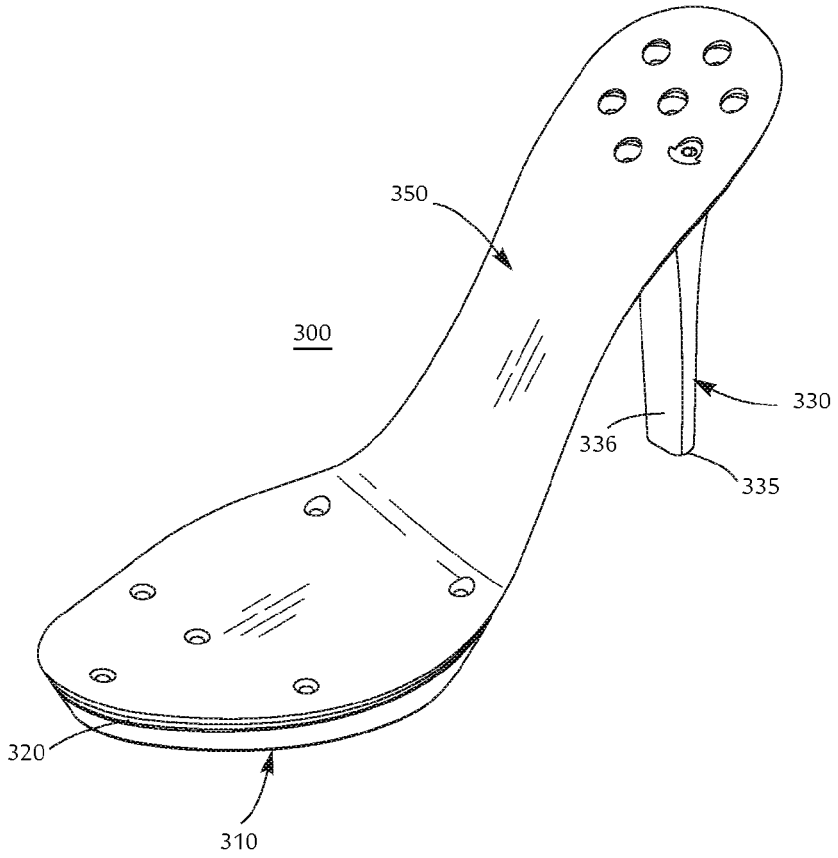
FIG. 3 is a perspective view of the main structural components of a second high heel shoe.

Referring now to FIG. 3, there is shown a second high heel shoe 300. Like the shoe 100, the high heel shoe 300 includes a toe bed 310, a shank 320 (mostly hidden), a heel 330 and an insole cushion 350. Whereas the toe bed 110 and the shank 110 of the shoe 100 twist, click and lock, in the shoe 300 the toe bed 310 and the shank 310 snap and lock together. While left and right side views may look the same, the left and right parts are different. In typical high heel shoes, the shank and heel are the same for the left and the right side. In the shoe 300, the left and right toe beds, shanks and heels are specific to each side. That is, the structural components of the left shoe and the right shoe are each tuned to provide lateral stability and comfort for the wearer.

The toe bed 310 provides a wide base and keeps the big toe pointed straight (at an approximately 10° angle).

The shank 320 is shaped to distribute weight for increased comfort. The shape of the shank 320 provides load balancing under often punishing conditions during use of the shoe 300. The shank 320 is made of a material such as nylon that when cured is relatively rigid and has sufficient strength to support the user's weight on the high heel shoe 300. The shape of the shank 320 is contoured to the geometry of the foot. The contoured shape along with the increased surface area compared to a conventional shank allow the forces of walking or standing to be more easily distributed through the shoe avoiding pressure points at the ball of the foot which cause pain and injury. Pitch is also improved.

There is generally a relationship between lift, stability and comfort of a shoe. The toe bed 310 and the shank 320 together provide at least 2 inches of lift, with 2-4 inches providing a good compromise between a desire for increased height and a desire for comfort and stability. This is based upon body geometry of a range of people and a standard configuration of the shoe 300 of component size, shape and behavior to accommodate that range. For a given person's body, there is generally a range where increasing lift has only a small impact on comfort and stability. Eventually, increased lift has increasing impact on comfort and stability. Furthermore, comfort and stability may vary independently, and an improvement in one may result in a decline in the other.

The heel 330 tapers downward from a relatively large upper end to a narrow lower end having a greater lateral dimension than a longitudinal dimension. This provides enhanced stability to the shoe 300 while maintaining a relatively thin and elegant profile from the side. The heel 330 therefore presents a generally conventional appearance with several functional variances which enhance comfort and/or stability. In this regard, the heel may taper from top to bottom 335 with maximized surface area of the bottom 335 at the point of strike with the ground while retaining a minimal and aesthetically appealing silhouette from the side view. This is achieved through the base shape of an oval or lozenged rectangle whose long dimension is at the heel breast 336 and provides up to triple the amount of striking surface of traditional stilettos. This increased surface area helps mitigate strain from foot strike and provides further balance support in the lateral direction, critical for walking in any areas of irregular or rough terrain. The heel 330 is further contoured in gentle curves in both the side and back views, furthering the appearance of an elegant minimal aesthetic similar to that of a traditional stiletto. The heel 330 may be made of a thermoplastic polyamide blend substrate, such as glass filled nylon, mixed to create maximum structural support while retaining impact absorption crucial for heel strike.

Figure 4:
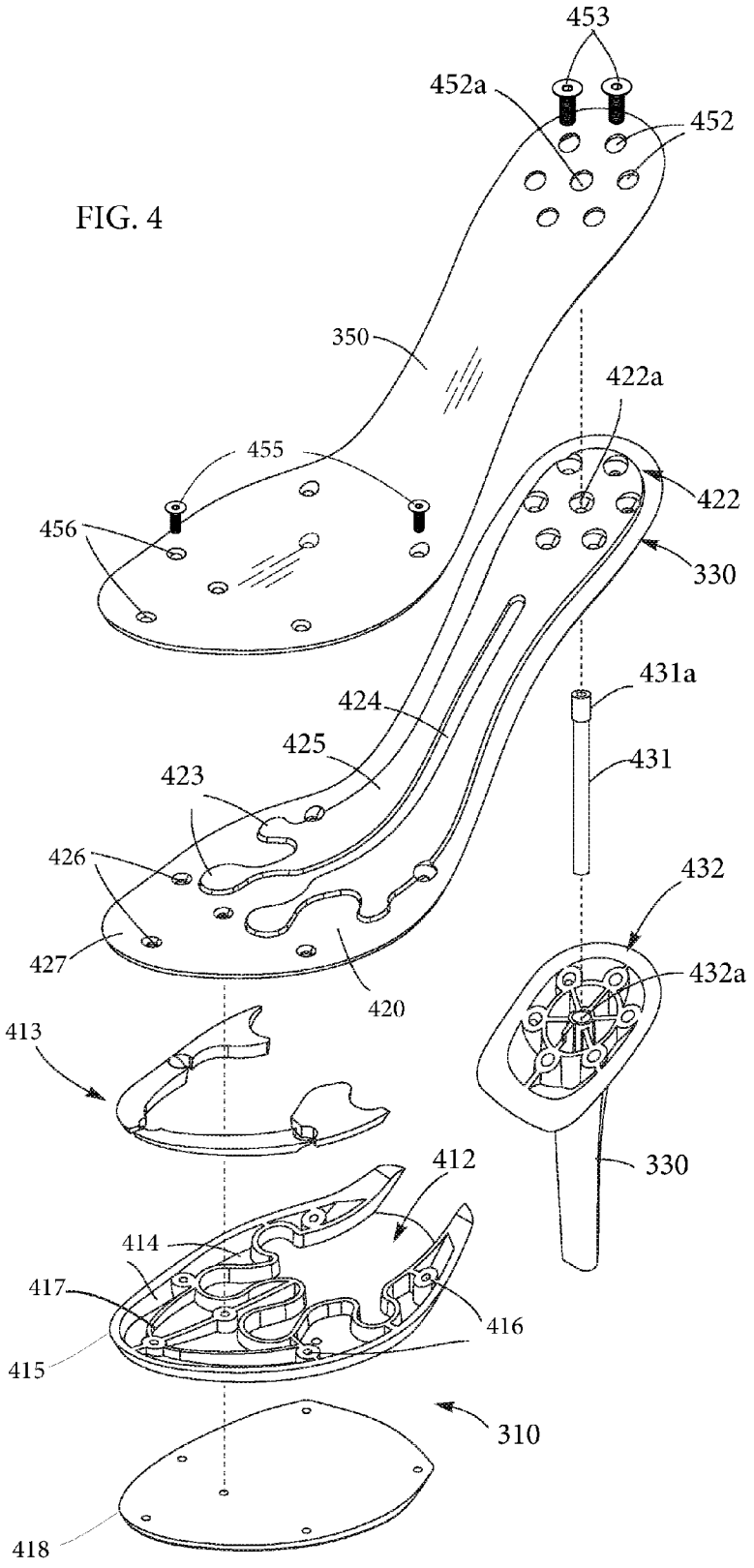
FIG. 4 is an exploded perspective view of the structural components of the second high heel shoe from above.

Referring now to FIG. 4 there is shown an exploded perspective view of the structural components of the high heel shoe 300 from above.

The insole cushion 350 is shown separated from the shank 320 but they may be unitary and co-molded. The insole cushion 350 may cover the entire upper surface of the shank 320, with a plurality of through holes 452 in the rear (heel) portion that correspond with through holes 422 in the shank 320. All but central through holes 422*a*, 552*a* align with threaded bores 432 opening upward in the heel 330.

To strengthen the junction of the shank 320 and heel 330, there may be a shaft 431 made of strong, rigid material which extends down into a central through bore 432*a* in the heel 330. The shaft 431 includes an upper reinforced end 431*a*. The shaft 431 may be tubular for lower weight, and may have a cross section of constant or varying shape and width, and may taper from the end 431*a* toward its bottom, like a dental implant. The bore 432*a* has a shape and dimensions complementary to those of the shaft 431 to achieve a snug fit. A friction fit and/or adhesive provided within the through bore 432*a* in the heel 430 may secure the shaft 431 therein. The shaft 431 may extend down to the bottom end of the through bore 432*a*, or a lower cap (not shown) may be inserted therein to cover any recesses.

The shank 320 has an upper raised area 425 which is relatively shallow compared to an outer edge 427 of the shank 320, which is itself thin to minimize weight but thick enough to provide sufficient support. The upper raised area 425 extends from the toe bed rearward to the heel area. The upper raised area 425 and the outer edge 427 generally conform to the contours of the wearer's foot, except for a plurality of forward lobes 423 in the upper raised area 425. The lobes 423 may be somewhat bulbous shaped. In the second high heel shoe 300 there are four lobes 423 and they are splayed outward in a pattern that resembles a gecko's foot. The gecko's foot shape mitigates the structural loading within the shank 320 by distributing forces within the shank 320 and passing them through to the outsole of the shoe 300. At least two lobes are necessary, and more than eight lobes generally less beneficial. A central channel 424 extends from a forward end of the upper raised area 425 and provides lateral flexibility to the shank 320.

The toe bed 410 has three parts, a middle rigid portion 415 sandwiched between an outsole 418 and a number of soft cushions 413. These three layers 413, 415, 418 are of different materials which combine to provide both stability and shock absorption to the ball of the foot during the foot strike of walking. The outsole 418 and soft cushions 413 may be formed through co-molding with the rigid portion 415 to form a unit. The rigid portion 415 includes a cavity 412 surrounded by a number of through holes 416 and cells 414 provided between cell walls 417. The soft cushions 413 fill the cells 414. Some of the cells 414, such as the two middle cells, may be left without cushions to provide some flexibility in the toe area and enhance comfort thereto. The rigid portion 415 may be made of nylon or other such rigid polymer, while the outsole 418 and cushions 413 may be formed of a soft polymer such as TPU.

Though the toe bed 310, the shank 320 and the heel 330 are formed respectively as units or parts which snap securely together, their joints may be enhanced. The shank 420 has through holes 426 in the toe region which line up with those 416 in the rigid portion 415. The through holes 416 in the rigid portion 415 may be threaded to receive fasteners 455 which pass through the through holes 426 to secure the toe bed 310 and the shank 320 together. Fasteners 453 may be installed through the holes 452, 422, 432 respectively in the insole cushion 450, the shank 320 and the heel 330. Fasteners 455 may be installed through the holes 456, 426, 416 respectively in the insole cushion 450, the shank 320 and the toe bed 310. These fasteners 452, 455 secure the respective parts.

Figure 5:
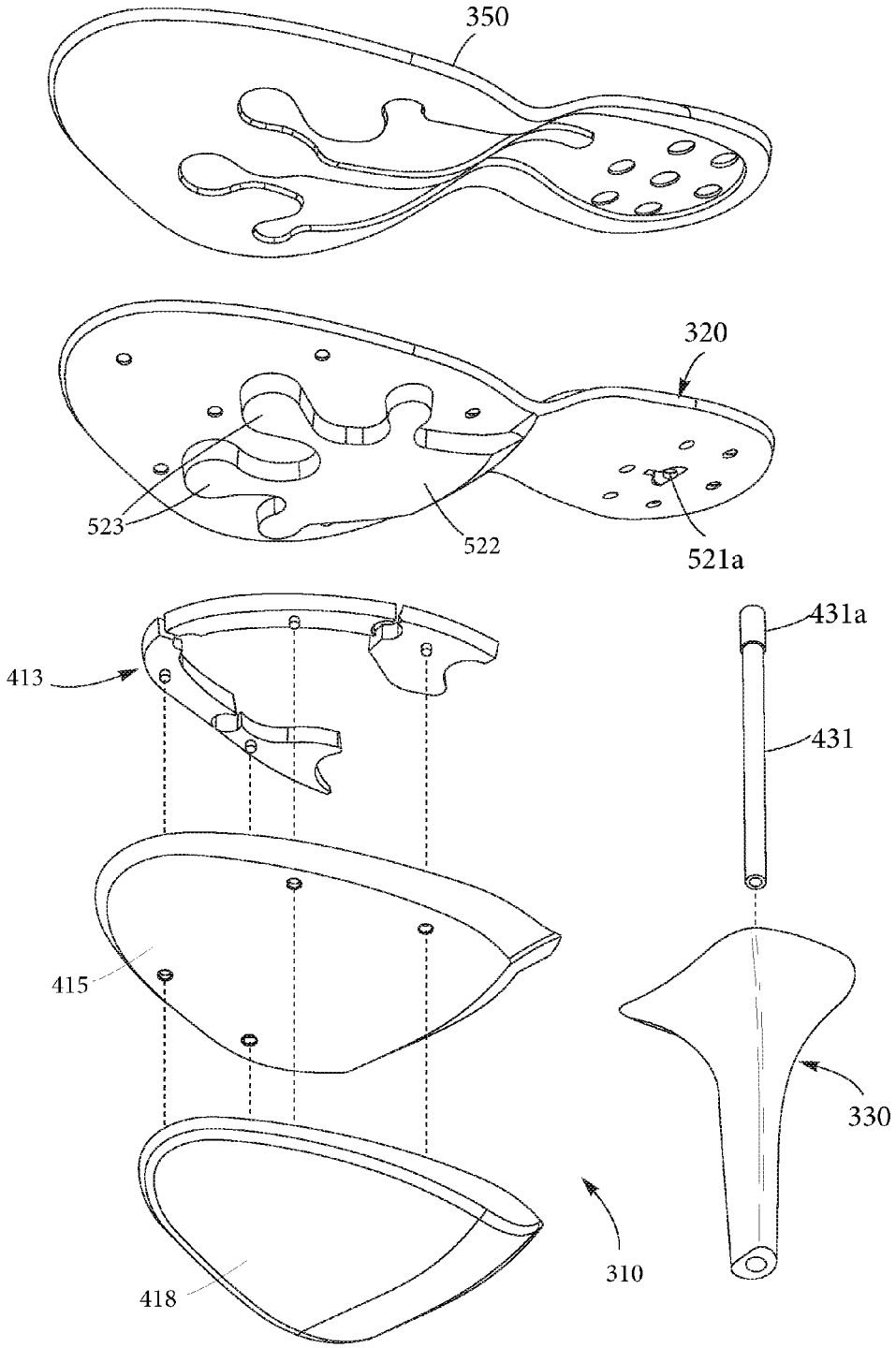
FIG. 5 is an exploded perspective view of the structural components of the second high heel shoe from below.

Referring now to FIG. 5 there is shown an exploded perspective view of the structural components of the high heel shoe 300 from below.

The upper reinforced end 431*a* of the shaft 431 fits closely into a recess 521*a* in the underside of the shank 320 concentric with the central through hole 422*a* (FIG. 4). The recess 521*a* and the end 431*a* have complementary shapes and dimensions to permit a close fit. Adhesives may be used to reinforce the connection.

A lower raised area 522 of the shank 320 has a plurality of forward lobes 523 which together mimic a gecko's foot. The lower raised area 522 extends rearward from the toe portion of the shank 320 and gradually diminishes prior to reaching the heel region of the shank 320. The lower raised area 522 is relatively thicker than the upper raised area 422 (FIG. 4) and fits snugly much like a puzzle piece into the similarly-shaped cavity 412 (FIG. 4) in the toe bed 310. The lobes 523 provide increased surface area for great contact between the shank 320 and the toe bed 310.

Figure 6:
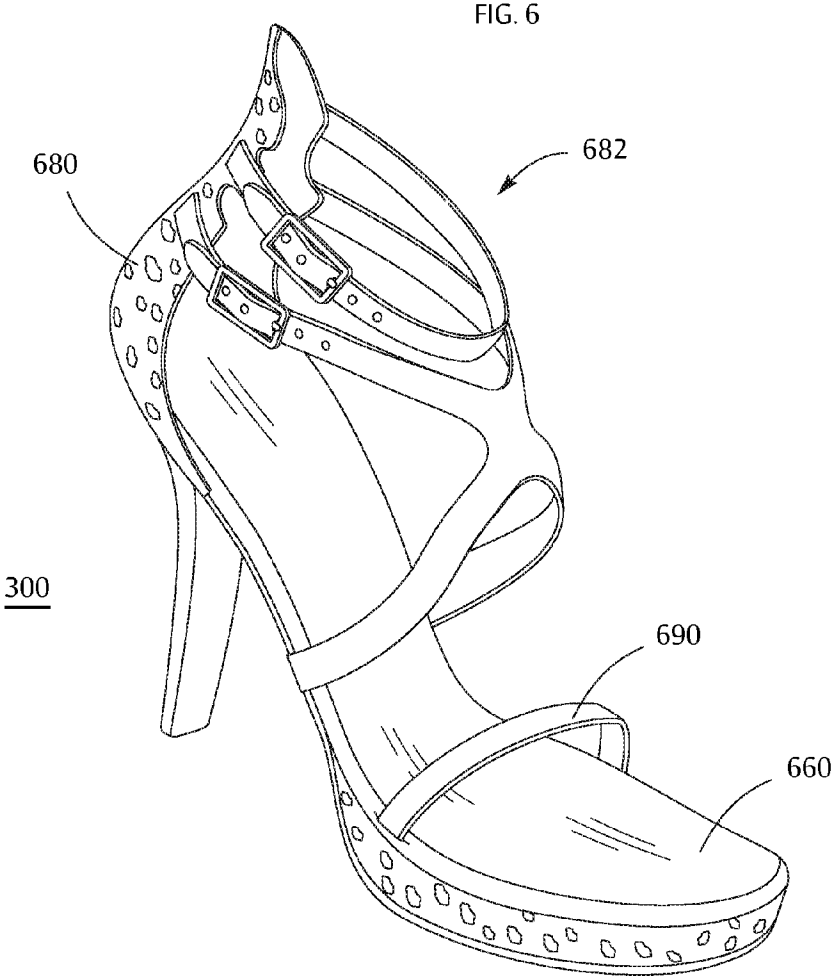
FIG. 6 is a perspective view of the second high heel shoe fully assembled.

Referring now to FIG. 6 there is shown a perspective view of the high heel shoe 300 fully assembled. In this view, components of an upper can be seen, including an insole 660, a counter 680 attached to one or more heel straps 682, and an arch strap 690.

The insole 660 is secured on top of the insole cushion 350 and covers the holes 452, 456 and top ends of the fasteners 453, 455 (FIG. 4). The heel straps 682 may be affixed below the insole 660, such as to the shank 320 or sandwiched between the shank 320 and toe bed 310. The arch strap 690 spans across the shoe 300 and may be affixed like the heel straps 682.

The counter 680, heel straps 682, arch strap 690 and other parts of the upper may include material (not shown) akin to that of the insole cushion 350. For example, the counter 680 may include two narrow channels of foam running longitudinally along the sides of the heel 330, holding the tendon of the back of the ankle in gentle compression. This provides structural support to hold the foot in place during walking without attempting to grip at the top of the heel 330, an area which generally gathers blisters from repeated rubbing.

The combination of toe bed 310, the shank 320 and the heel 330 provide a platform suitable to a limitless variety of aesthetic upper designs. One or more straps running across the top of the foot provide support during walking, especially during the lifting of the foot. The straps may be aligned with cushions to provide padding and compression which serves to hold the foot in place inside the shoe and increases stability during stepping. The straps may be disposed midway between the toe bed 310 and the ankle.

Figure 7:
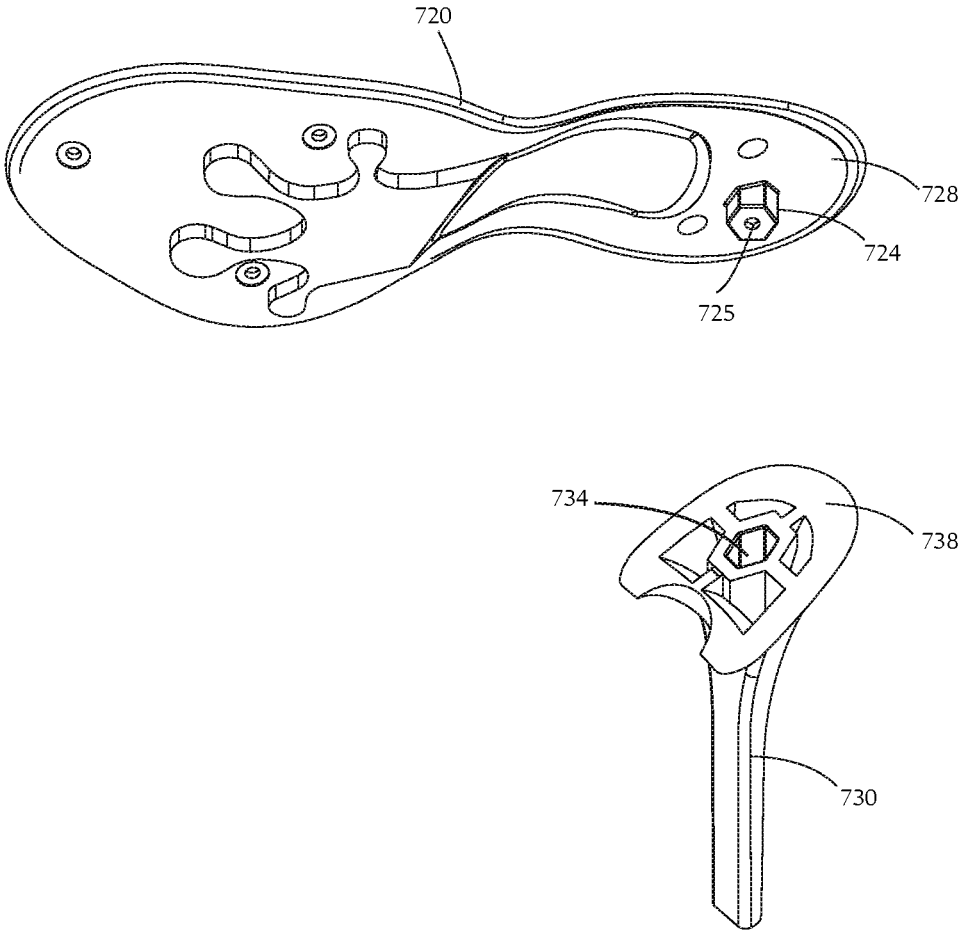
FIG. 7 is a perspective view of a shank and a heel as alternatives to those of the second high heel shoe.

Referring now to FIG. 7 there is shown a perspective view of a shank 720 and a heel 730 as alternatives to those 320, 330 of the second high heel shoe 300. To strengthen the junction of the shank 720 and heel 730, a non-circular reinforcing member 724 formed in the shank 720 extends down into a cavity 734 in the heel 730. The reinforcing member 724 fits snugly into the cavity 734 and provides a non-rotatable coupling. The member 724 and cavity 734 may both be hexagonal, or may have different but compatible shapes and dimensions. As in FIG. 4, one of the fasteners 453 extends downward through a bore 725 in the reinforcing member 724 and secures into the cavity 734. Adhesive may also be provided between the reinforcing member 724 and the cavity 724 for added strength, and also between an upper surface 738 of the heel 730 and a contacting lower surface 728 of the shank 720.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of" respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A high heel shoe assembly comprising:

a rigid shank and a soft upper insole cushion joined with the shank, the shank extending from a toe end to a heel end, wherein the heel end is elevated above the toe end by at least two inches;

a toe bed comprising a rigid middle portion defining cells filled with a plurality of soft cushions and a soft lower layer underneath the middle portion, the middle portion being secured to an underside of the toe end of the shank;

a high heel secured to an underside of the heel end of the shank, the high heel tapering downward from a relatively large upper end to a narrow lower end having a greater lateral dimension than a longitudinal dimension; and flexible uppers, an outsole secured underneath the toe bed and a portion of the shank, and an insole secured above the shank and soft upper insole cushion for holding the shoe onto a foot of a wearer.

2. The assembly of claim 1, wherein the shank has a central plate-like body and a lower raised area defining a plurality of forward projections splayed in different directions across a plane of the shank that interlock with a complementary shape in an upwardly-opening cavity of the middle portion of the toe bed.

3. The assembly of claim 1, wherein shank has a central plate-like body and an elongated central rib that projects below the body and commences generally at the rear edge of the toe bed and extends rearward to the heel but does not extend to lateral sides of the body.

4. The assembly of claim 1, wherein the fasteners include a series of bolts or screws that pass down through aligned through holes in the soft upper insole cushion and shank and into threaded bores opening upward in the middle portion of the toe bed.

5. The assembly of claim 1, wherein the shank and a soft upper insole cushion are co-molded together into a unitary member.

6. The assembly of claim 1, wherein the heel lower end has a shape of an oval or lozenged rectangle whose greatest lateral dimension is at a front face thereof.

7. The assembly of claim 1, wherein the heel is secured to an underside of the heel end of the shank using at least one fastener passed downward through the shank.

8. The assembly of claim 7, wherein the heel is secured to an underside of the heel end of the shank using a plurality of fasteners, a central one of which engages an upper reinforced end of a shaft that extends down into and is secured within a central through bore in the heel.

9. The assembly of claim 7, wherein the heel is secured to an underside of the heel end of the shank using a non-circular reinforcing member in the shank that extends down and fits snugly into a similarly-shaped cavity in the heel, and the fastener passes through the reinforcing member and into the cavity.

10. A high heel shoe assembly comprising:

an upper platform subassembly including a relatively rigid shank portion and a soft upper layer co-molded to the shank portion, the upper platform extending from a toe end to a heel end, wherein the heel end is elevated above the toe end, the rigid shank portion having a plate portion and a lower raised area;

a toe bed comprising a relatively rigid middle portion and a soft lower layer underneath the middle portion, the toe bed having an upwardly-opening cavity that closely receives the lower raised area on the rigid shank portion and being secured to an underside of the toe end of the upper platform;

a high heel secured to an underside of the heel end of the upper platform; and flexible uppers and an insole secured above the upper platform for holding the shoe onto a foot of a wearer;

wherein the lower raised area of the shank portion defines a plurality of forward projections splayed in different directions across a plane of the shank portion, wherein the plurality of forward projections interlock with a complementary shape in the cavity of the toe bed.

11. A high heel shoe assembly comprising:

a relatively rigid shank and a soft upper insole cushion co-molded to the shank, the shank extending from a toe end to a heel end, wherein the heel end is elevated above the toe end, the shank having a central plate-like body and a lower raised area;

a toe bed comprising a relatively rigid middle portion and a soft lower layer underneath the middle portion, the middle portion having an upwardly-opening cavity that closely receives the lower raised area on the shank and being secured to an underside of the toe end of the shank;

a high heel secured to an underside of the heel end of the shank; and flexible uppers, an outsole secured underneath the toe bed and a portion of the shank, and an insole secured above the shank and soft upper insole cushion for holding the shoe onto a foot of a wearer;

wherein the lower raised area of the shank defines a plurality of forward projections splayed in different directions across a plane of the shank, wherein the plurality of forward projections interlocks with a complementary shape in the cavity of the toe bed.

12. The assembly of claim 11, wherein the shank has an upper raised area from the central plate-like body defining a plurality of forward projections that are splayed outward so as to distribute forces within the shank and pass them through to the outsole of the shoe.

13. The assembly of claim 12, further including a central channel extending from a forward end of the upper raised area that provides lateral flexibility to the shank.

14. The assembly of claim 11, wherein the lower raised area of the shank defines a plurality of forward projections splayed in different directions across a plane of the shank that interlock with a complementary shape in the upwardly-opening cavity of the middle portion of the toe bed.

15. The assembly of claim 14, wherein the plurality of forward projections are bulbous lobes splayed outward in a pattern that resembles a gecko's foot.

16. The assembly of claim 11, wherein the shank is made of Nylon and soft upper insole cushion is a thermoplastic polyurethane.

17. The assembly of claim 11, further including a plurality of soft cushions co-molded with the soft lower layer around the middle portion of the toe bed, the soft cushions filling cells defined in an upper surface of the middle portion.

18. The assembly of claim 11, wherein the shank further includes an elongated central rib that projects below the central plate-like body and commences generally at the rear edge of the toe bed and extends rearward to the heel but does not extend to lateral sides of the body.

19. The assembly of claim 11, wherein the heel is secured to an underside of the heel end of the shank using a plurality of fasteners, a central one of which engages an upper reinforced end of a shaft that extends down into and is secured within a central through bore in the heel.

20. A high heel shoe assembly comprising:

a relatively rigid polymer shank and a soft upper insole cushion co-molded to the shank, the shank angling upward from a toe end across an arch portion to a heel end, the shank having a lower raised area from a central plate-like body extending across the arch portion and into a portion of the toe end, the lower raised area having a plurality of separated forward projections;

a toe bed comprising a relatively rigid middle portion and a soft lower layer underneath the middle portion, the toe bed having an upwardly-opening cavity shaped to closely receive the separated forward projections of the lower raised area on the shank and being secured to an underside of the toe end of the shank;

a rigid polymer high heel secured to an underside of the heel end of the shank using at least one fastener; and flexible uppers, an outsole secured underneath the toe bed and a portion of the shank, and an insole secured above the shank and soft upper insole cushion for holding the shoe onto a foot of a wearer.

21. The assembly of claim 20, wherein the heel is secured to an underside of the heel end of the shank using a plurality of fasteners, a central one of which engages an upper reinforced end of a shaft that extends down into and is secured within a central through bore in the heel.

22. The assembly of claim 20, wherein the heel is a glass filled nylon.

23. The assembly of claim 20, wherein the shank has an upper raised area from the central plate-like body defining a plurality of forward projections that are splayed outward so as to distribute forces within the shank and pass them through to the outsole of the shoe.

24. The assembly of claim 23, further including a central channel extending from a forward end of the upper raised area that provides lateral flexibility to the shank.

25. The assembly of claim 20, wherein the forward projections in the lower raised area of the shank are bulbous lobes splayed outward in a pattern that resembles a gecko's foot as does the upwardly-opening cavity of the middle portion of the toe bed.

26. The assembly of claim 20, wherein the shank is made of Nylon and soft upper insole cushion is a thermoplastic polyurethane.

27. The assembly of claim 20, further including a plurality of soft cushions co-molded with the soft lower layer around the middle portion of the toe bed, the soft cushions filling cells defined in an upper surface of the middle portion.

28. The assembly of claim 20, wherein the shank further includes an elongated central rib that projects below the central plate-like body and commences generally at the rear edge of the toe bed and extends rearward to the heel but does not extend to lateral sides of the body.

29. The assembly of claim 20, wherein the heel tapers downward from a relatively large upper end to a narrow lower end having a greater lateral dimension than a longitudinal dimension, and the lower end has a shape of an oval or lozenged rectangle whose greatest greater lateral dimension is at a front face thereof.

* * * * *